United States Patent [19]

Foley

[11] Patent Number: 4,676,734

[45] Date of Patent: Jun. 30, 1987

[54] MEANS AND METHOD OF OPTIMIZING EFFICIENCY OF FURNACES, BOILERS, COMBUSTION OVENS AND STOVES, AND THE LIKE

[76] Inventor: Patrick J. Foley, 86 Hillsdale, Ames, Iowa 50010

[21] Appl. No.: 859,827

[22] Filed: May 5, 1986

[51] Int. Cl.[4] ..... F23N 1/00

[52] U.S. Cl. ..... 431/12; 110/186; 110/190; 110/341; 236/15 BD

[58] Field of Search ..... 431/2, 12; 110/341, 110/186, 190; 236/15 E, 15 BD

[56] References Cited

U.S. PATENT DOCUMENTS

| | | | |
|---|---|---|---|
| 4,045,292 | 8/1977 | Matsushita . | |
| 4,054,408 | 10/1977 | Sheffield et al. | 431/12 |
| 4,238,185 | 12/1980 | Watson . | |
| 4,309,949 | 1/1982 | Rastogi | 431/2 X |
| 4,330,261 | 5/1982 | Sun . | |
| 4,421,473 | 12/1983 | Londerville . | |
| 4,439,138 | 3/1984 | Craig . | |
| 4,449,918 | 5/1984 | Spahr . | |
| 4,474,121 | 10/1984 | Lewis . | |
| 4,576,570 | 3/1986 | Adams et al. | 431/12 |

OTHER PUBLICATIONS

"Monitoring Powerplant Performance", *Power*, vol. 128, No. 9, Sep., 1986, pp. S1-S24.

*Primary Examiner*—Edward G. Favors

*Attorney, Agent, or Firm*—Zarley, McKee, Thomte, Voorhees & Sease

[57] ABSTRACT

A means and method for optimizing the efficiency of combustion devices such as furnaces, boilers, ovens, stoves, and the like which automatically tests for and controls the amount of input air utilized by the combustion device to optimize combustion efficiency. The method constantly increases or decreases the amount of input air and monitors the output of the combustion device to see if the change in input air increases or decreases efficiency. If efficiency is increased, the amount of input air is continued to be changed in that direction. If the efficiency is decreased, the change of excess air is reversed. By continuously testing for optimal air fuel ratios, optimal efficiency is reached. The means to accomplish the method include an output monitor, an air input control means, and recording means for recording the output of the combustion device as it presently exists compared to its former reading. A math unit then compares the two readings and depending upon whether output is increased or decreased, utilizes a logic control to signal a switching means which sends a signal to either increase or decrease the input air to the air control means. The means and method can be utilized with combustion devices having variable fuel and air input, or with combustion devices which have a fixed fuel input or which must output at a fixed level.

17 Claims, 4 Drawing Figures

MEANS AND METHOD OF OPTIMIZING EFFICIENCY OF FURNACES, BOILERS, COMBUSTION OVENS AND STOVES, AND THE LIKE

BACKGROUND OF THE INVENTION

1. Field of the Invention

The present invention relates to a means and method of optimizing the efficiency of combustion devices such as furnaces, boilers, ovens, stoves, and the like, and in particular, relates to an automatic control means and method for determining and holding the combustion device at an optimum efficiency level.

2. Problems in the Art

Until only relatively recently, fossil or fossil-based fuels were in ready supply and thus were available at low or nominal cost. Combustion devices such as furnaces, boilers, ovens, stoves and the like, thus were economical to run regardless of efficiency.

The tremendous industrial expansion and corresponding depletion of world supplies of fossil fuels has made efficiency for combustion devices a critical aspect in their use. Whether it be large scale heating plant furnaces or boilers, or household fossil fuel burning ovens or stoves, the very much higher cost and increasing scarcity of fossil fuels has required introducion of methods to increase efficiency to decrease the amount of fuel used per unit of output.

Whereas the actual construction and operating structure and elements of the combustion devices have been extensively redesigned or modified to produce significant increases in efficiency, a major problem still exists in controlling the basic combustion process. Combustion is a product of combustible fuel with oxygen.

In combustion devices, it is required that an excess amount of air (containing the needed oxygen), over the stoichiometric amount needed for combustion, be utilized for the following reasons. If the combustion process has insufficient air, first, there would be incomplete combustion thereby wasting fuel, secondly, there would be slagging problems because of incomplete combustion, and thirdly and most significantly, the risk of overheating, damage to the device, and even explosion is dramatically increased. Therefore, all combustion processes make sure that excess air is always available.

However, too much excess air decreases the efficiency of the furnace or combustion device by increasing the heat loss out the stack. However, the danger of explosion is not there.

Therefore, there is a real need to develop a system by which the level of excess air for a given fuel supply is maintained at an "optimum" level where there is a compromise between combustible losses and heat losses from heated excess air leaving the furnace.

Conventionally, targets for excess air levels are created on the basis of imperical knowledge of the combustion process. Combustion engineers therefore calculate the amount of air input to the device based upon the known properties of the fuel and the output of the furnace. While this gives a general estimate, there is much room for error in that the properties of fuel change significantly during combustion, the calculations based on output and properties of the fuel are mere approximations, and in many of these combustion devices, the load (firing rate) changes over time. The combustion engineer can attempt to diminish these variables by monitoring the excess air level generally using a $O_2$ (Oxygen) analyzer. By closely limiting the amount of excess air, as indicated by the gas analyzer, and diligently keeping the air at approximately the most efficient level, significant efficiency improvement can be realized. For example, in a large scale coal burning furnace, by reducing the excess air to achieve optimal combustion without danger, an increase in efficiency of 1% could mean millions of dollars per year.

Automatic control of the excess air level is implemented by the economy of the microprocessor art. Examples of the use of automatic furnace combustion controls can be found in the following U.S. Pat. Nos: 4,045,292; 4,238,185; 4,330,261; 4,421,473; 4,439,138; 4,449,918; and 4,474,121. In attempting to automatically control the combustion parameters to optimize efficiency, some of these methods and apparatus attempt to minimize excess air by looking to the combustion byproducts for indication of how much air needs to be input. The problems exhibited by such methods are that the equipment needed to derive the required information about the gases are inherently unreliable, are subject to significant error, and are generally expensive to purchase, install, and maintain. Additionally, they require periodic calibration and if disabled or miscalibrated, the system simply does not function according to its intended advantage. Also, combustion systems are always subject to leakage as to air and the gaseous components and therefore the gas readings may be misleading for that reason. Note U.S. Pat. No. 4,449,918.

The combustion engineer can check his control of the excess air level by checking the efficiency of his furnace by energy accounting, either by using the losses method (as is known in the art) or by careful measurement of the fuel input and output of the furnace. The engineer could even try different excess air levels and re-test the efficiency for a gain. Howver, these methods are tedious, subject to error and not used for day-to-day operation of a furnace.

It is therefore a principal object of the invention to provide a means and method for optimizing efficiency of a combustion device which improves over or solves the deficiencies in the art.

A further object of the invention is to provide a means and method of optimizing efficiency of a combustion device which determines optimal efficiency excess air levels by monitoring generally the output of the combustion device during testing.

Another object of the invention is to provide a means and method of optimizing efficiency of a combustion device which continually tests for optimal combustion efficiency and insures that a minimum required amount of excess air is always available.

Another object of the invention is to provide a means and method of optimizing efficiency of a combustion device which determines whether to increase or decrease air input by evaluating changes in rate of output of the combustion device over time.

A further object of the invention is to provide a means and method of optimizing efficiency of a combustion device which can be utilized in combustion devices having variable fuel and air inputs or fixed fuel input.

A further object of the invention is to provide a means and method of optimizing efficiency of a combustion device which utilizes a retrofittable control circuitry operable with existing combustion device hardware to achieve its result.

Another object of the invention is to provide a means and method of optimizing efficiency of a combustion device which can be adjusted to have various testing periods, various increments of increase or decrease in excess air during testing, and various reset capabilities.

A further object of this invention is to provide a means and method for optimizing efficiency of a combustion device which can utilize either microprocessor apparatus or analog apparatus to accomplish its functions.

A further object of this invention is to provide a means and method of optimizing efficiency of a combustion device which is economical, durable, accurate and efficient.

These and other objects, features and advantages will become apparent with reference to the accompanying specification and drawings.

SUMMARY OF THE INVENTION

The present invention seeks to improve over the deficiencies in the art by presenting a means and method for optimizing the combustion efficiency of combustion devices such as furnaces, boilers, ovens, stoves, and the like, by presenting a system which can be easily retrofitted to existing structures, utilizes the existing combustion parameter indicators, and continually tests and retests the output and fuel input rate to determine the proper amount of excess air.

The method begins with monitoring continuously the output of the combustion device. At a desired time, the output level of the combustion device is recorded. The amount of air input to the device is then increased a small amount. The output is then looked at and recorded, and then the prior output is subtracted therefrom, thus deriving a remainder which would reflect whether output has been increased or decreased, i.e., whether efficiency has been raised or lowered. According to this result, the control circuit signals a switch which is in control of the air input control to the combustion device to either increase or decrease input air. For example, if the air is increased an amount and a comparison to the previous furnace output shows that output has been raised, the control circuit signals the air input to again allow a further increment of air to be input. If output again rises, this air-increasing incremental increase will continue. When a point is reached where output decreases, the process will reverse with the air input being signaled to decrease air an amount.

When the optimal combustion efficiency is approached, the control circuitry will oscillate around the optimal air input setting. To refine efficiency, the control circuit automatically trims the amount the air input is changed, to allow the efficiency to settle on the zone of optimal efficiency. When this point is reached, the circuit goes into a stand-by mode and restarts when either reset or a drop in efficiency is determined by the circuit. The invention can be utilized for combustion devices which have variable outputs (loads), and therefore need constant correction depending upon the amount of heat being required, but also can be utilized with combustion devices having fixed (batch) fuel input or devices which are required to produce an output at a set level. For devices having a variable fuel input, and which are required to produce variable outputs over time, instead of just monitoring device output, the control circuit also monitors fuel input and divides output by fuel input before making a comparison with the previous furnace setting. Similarly, for devices having a required output, the amount of fuel being input is looked at in association with maintenance of the desired output prior to signalling the incremental testing of input air.

The means to accomplish the method can utilize either existing microprocessor or microcomputer art, or can be analog. The means requires appropriate transducers (known-in-the-art) to convert the furnace output rate and fuel input rate readings into electrical signals usable by the control circuit. Likewise, either analog or digital memory is needed to store the prior output reading for mathematical operations.

Additionally, electronic control means are required to send signals to the air input of the combustion device to incrementally increase or decrease the excess air level.

Other features and elements include hardware or software cycle timers to control the operational sequencing of the control circuit, manually adjustable elements to control the amount of increment and the timing of the increments, and logic to limit increment changes and to shut off and restart the device.

DETAILED DESCRIPTION OF THE PREFERRED EMBODIMENT

Figure 1:
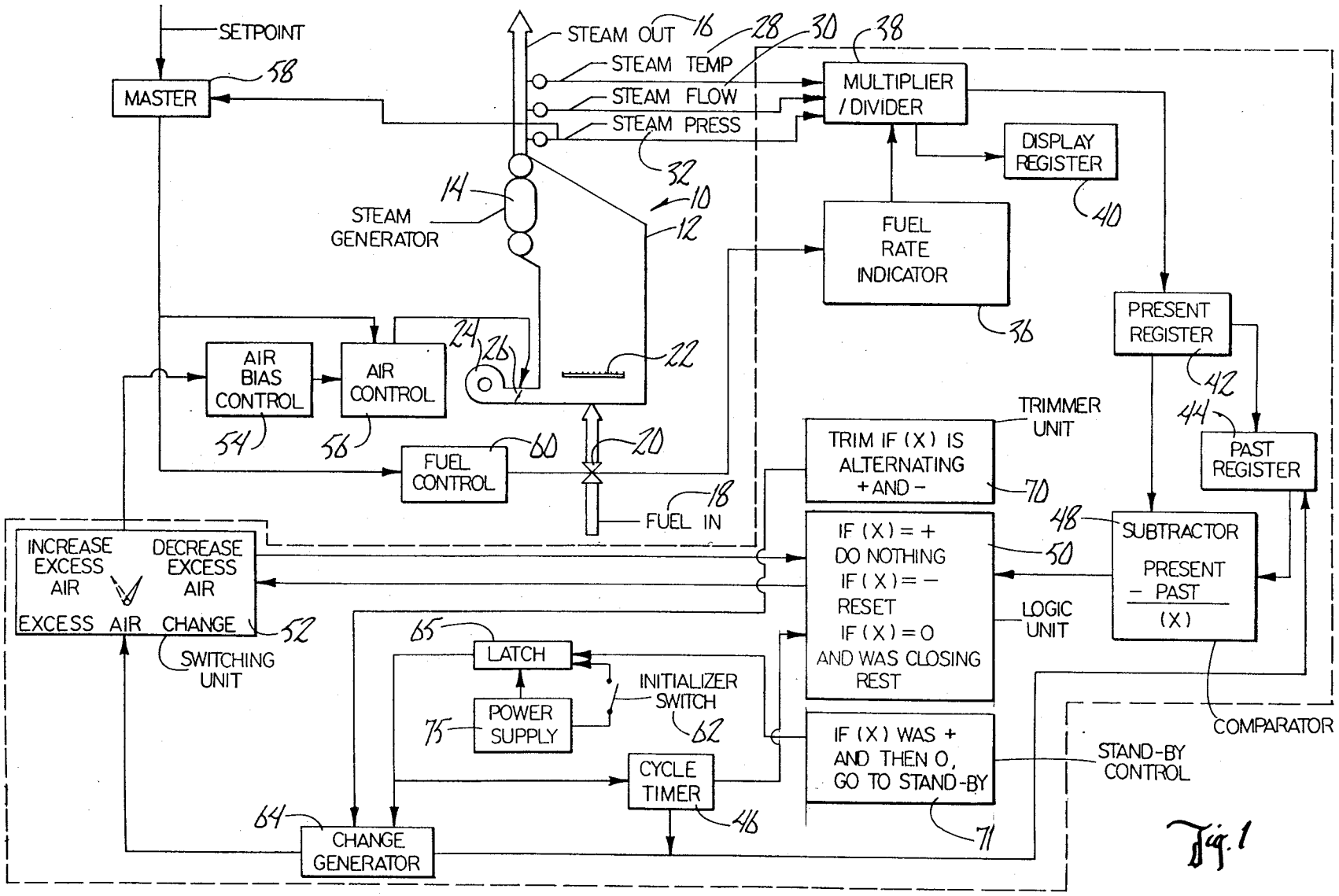
FIG. 1 is a schematic of the invention as applied to a combustion device having variable fuel and air inputs and variable outputs, in particular, a boiler for producing steam.

With reference to the drawings, and particularly FIG. 1, there is shown a combustion device 10 which is a large scale boiler furnace 12 which creates heat to operate steam generator 14. The steam output and outlet is represented by arrow 16 and fuel input is represented by arrow 18. The components can be either analog or digital, as is known in the art.

Fuel input 18 is accomplished by any number of conventional fuel input apparatus 20 such as are known in the art to feed fossil fuel such as coal, oil, natural gas, and the like to burners 22 of boiler furnace 12. Combustion air is input through combustion air input fan 24 which contains an adjustable damper 26.

Three output monitors or transducers are operatively connected to outlet 16 of steam generator 14 to measure output. A steam temperature monitor 28, steam flow monitor 30 and steam pressure monitor 32 are conventional and known within the art and are standard equipment to monitor the output parameters of combustion device 10.

The signals from monitors 28, 30 and 32 are connected to multiplier leads of the multiplier-divider math unit 38. Pressure monitor 32 is also connected to master control 58. The signals from the fueling rate indicator or transducer 36 are put into connection with divider leads of multiplier-divider math unit 38. Fueling rate transducer 36 is put in operative connection with the fuel feed apparatus 20 and produces a signal corresponding to the rate of feed. For example, a potentiometer connected and calibrated to the rate or speed of the apparatus feeding the fuel could be used. The multiplier-divider 38 corrects the flow output recorded by monitor 30 for variations in pressure and temperature by multiplying the variables of output monitors 28, 30 and 32 together. This product is then divided by the signal from fuel rate indicator 36. The resulting quotient is a ratio of output-to-input for combustion device 10. The multiplier-divider 38 can consist of analog components, or, if digital techniques are used, multiplier-divider 38 first translates the analog signals from 28, 30, 32 and 36 into (binary) digital by A/D (analog to digital) converters (not shown), as are known in the art.

A display register 40 can optionally be connected to the output of 38 for a visual display of this quotient.

The past counter register 44 accepts the quotient signal of multiplier-divider 38 and stores it when updated by cycle timer 46. Cycle timer 46 serves to control how long the quotient from multiplier-divider 38 is held in past register 44 so that the quotient that is stored in past register 44 is always the quotient preceding the present quotient in present register 42. In other words, past register 44 always holds the previous output/input ratio of multiplier-divider 38 to compare with the present output/input ratio which is immediately put into present register 42. In the embodiment of FIG. 1, the output/input ratio of furnace 12 would be steam-generator-output-to-fuel-rate-input. The present register 42 is connected to a subtractor unit 48 and past register 44. Again, past register 44 is updated whenever a signal from cycle timer 46 is received.

The second math unit (subtractor 48) then subtracts the past value of 42 stored in 44 from the present value signal 42 to arrive at a remainder (referred to as X) which represents the comparison between the present output/fuel ratio of combustion device 10 and its immediately former output/fuel ratio, as previously recorded in past register 44. X is either a positive value, negative value, or zero.

This X value is then transmitted to logic unit 50 which, in the preferred embodiment, operates as follows. If X is positive, logic unit 50 issues no signal. If, however, X is negative, a signal is issued. Finally, if X is equal to zero, logic unit 50 may issue a signal if certain conditions in other elements of the circuitry exist, which are described below.

Logic unit 50 is communicable with excess air change switching unit 52. Switching unit 52 is essentially a switch which has two states, namely, "increase excess air" or "decrease excess air". Switching unit 52 is connected to an air control bias 54 which is in turn connected to air control 56 which directly controls mechanical opening, closing and positioning of damper 26 of air input fan 24 of combustion device 10. It can thus be seen that depending upon which state switching unit 52 exists in ("increase air" or "decrease air"), a signal is sent to air control bias 54 which in turn directs air control 56 to accordingly open damper 26 to increase the rate and amount of air input or close damper 26 to reduce the rate and amount of air input.

Master control 58 exists in the system to receive instructions as to what output 16 is desired for combustion device 10. Master control 58 therefore, after receiving the set point for output (set by the operator) controls the fuel control 60 which directs fuel feed apparatus 20 as to how much fuel is needed to be input to combustion device 10 to maintain the desired target output. As noted, master control 58 obtains output information from steam pressure output monitor 32. Thus, master control 58 also principally controls air control 56 to move damper 26 to the correct opening for the appropriate fuel input to achieve the desired output.

An initializer switch 62 is connected to switching unit 52 and serves to, first, set switching unit 52 to the "increase air" state after an adjustable period of time the control circuit is turned on and, secondly, sets latch 65 which turns on change generator 64. Change generator 64 is also connected to switching unit 52. Change generator 64 (alternatively can be called an increment changer) is manually adjustable to set how much air is increased or decreased upon each signal from cycle timer 46. Change generator 64 is also a timer which controls the length of the change signal going to switching unit 52. Cycle timer 46 serves to control the timing of how often the control circuitry sends signals to charge generator 64 and the updating of the value in past register 44.

An optional component to the logic unit 50 of FIG. 1 is a trimmer 70. Trimmer 70, upon detecting alternate positive ("+") and negative ("−") values of "x" from subtractor 48, will trim or reduce the increment of the amount of air control change allowed by air control 56 in the direction signalled by change generator 64. Another alternative addition is automatic "off" and "on" stand-by control 71, which is connected to latch 65. Stand-by control 71 will, upon receiving alternate "0" and negative values for (X) from subtractor 48 (or alternate positive and "0" values for (X), will shut off change generator 46, thereby performing its "auto off" function, and putting the system on standby. On the other hand, stand-by control 71 will perform its "auto on" function when the "auto off" (or "stand-by") mode is engaged, by continuing to monitor the (X) valves from subtractor 48 and restarting the control circuit of invention with the same action as initializer switch 62 when (X) goes to a negative value, by resetting latch 65. Optionally, initializer switch 62 can be manually or automatically adjusted to reset switching unit 52 to an "increase air" state after every set period of time, (e.g., two hours, two days, or any other selected period). This could be done by using another timer (not shown) as is known in the art.

Operation of the embodiment of the invention shown in FIG. 1 proceeds as follows. Combustion is started in boiler furnace 12 by the introduction of fuel through fuel apparatus 20 and the introduction of air through input fan 24 as controlled by damper 26. The pressure signal from monitor 32 is compared to the setpoint at master 58 which sends a signal proportional to the error between the setpoint and the pressure to the air control 56 and the fuel control 60 to regulate the firing rate. Air bias 54 controls the proportion of air-to-fuel and that is set by operator preference or a gas analyzer to an arbitrary level. These procedures are conventional in the art. In the preferred embodiment of the invention, air bias control 54 is modified to allow the air-to-fuel proportion to be controlled by the invention. A regulated power supply 75 is supplied to the circuit and is controlled by latch 65 to power change generator 64. Power supply 75 can also supply power to the other components of the circuitry, as needed.

Figure 4:
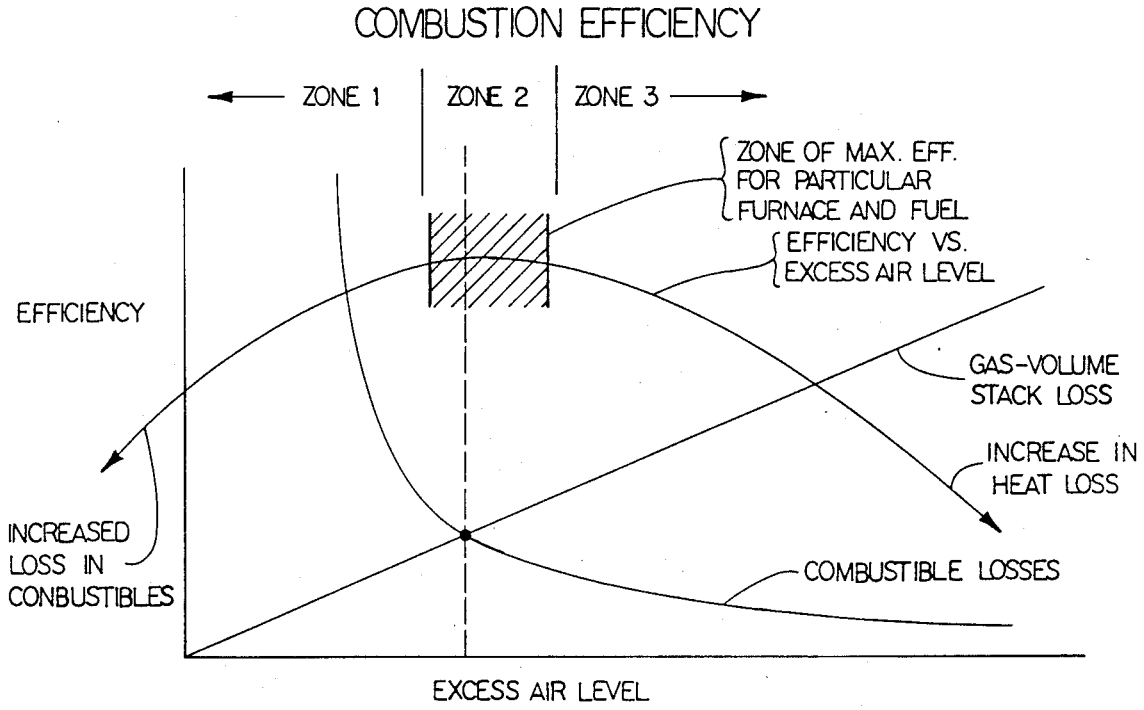
FIG. 4 is a plot of efficiency as a function of excess air as applied to a combustion device previously having no automatic control circuits.

The multiplier-divider unit 38 of the invention does not determine the actual efficiency of the furnace but rather obtains a ratio of the variables which greatly affect efficiencY, namely, the rate of output and the rate of input. This ratio is then used to evaluate furnace output changes caused by manipulated variations in the excess air level after waiting a sufficient time period for the furnace to stabilize after each excess air level change. The operation of the circuit begins when initializer switch 62 is closed. Initializer switch 62 allows past register 44 to record the signal from multiplier-divider unit 38, to start cycle timer 46, set air changer 52 to "increase" state, sets power latch 65, and enables change generator 64, which sends a signal to incremently change the excess air level by operating switching unit 52. After a period of time, cycle timer 46 cues logic unit 50 to act upon the (X) value from subtractor 48. If the value is positive (+), the furnace excess air level must be in zone 1 (refer to efficiency vs. excess air curve in the graph of FIG. 4). If it is zero (zone 2), it also allows the circuit to again increase the air. However, if the value of (X) is negative, the excess air level must be in zone 3 and the logic will set the air changer 52 to allow the excess air to incremently decrease. The excess air level will often alternate between zone 1 and zone 3 (see FIG. 4), if the incremental excess air changes are too big. Then optional trim features (discussed above) can be used to decrease the amount of change input to allow the circuit to find the maximum ratio. A further option is "stand-by mode", allowing smooth operation after finding the best excess air level. The circuit can go to "standby mode" after either increasing excess air in zone 1 and the next testing cycle produces an (X) value close to or equal to zero, or when in zone 3, decreasing excess air when (X) approaches zero.

Logic 50 then can start stand-by mode by opening latch 65 and shutting off change generator 64. The multiplier/divider 38 and subtractor 48 continue to monitor the efficiency of the unit. If a −(X) is determined, initializer switch 62 is closed. Initializer 62 can also be closed manually or automatically from time to time to check the excess air level.

Logic unit 50 incorporates logic helpful for troublesome fuels which often accumulate in the furnace during low excess air operation. The logic unit 50 can be set to alternate between zone 2 and zone 3. This option allows increased furnace temperature and air flow periods which burn up the excess fuel which often accumulated under previous methods. Also, it is a safety measure to prevent excursions into zone 1.

It is to be understood that the invention can function either with analog components or digital components. Digital components are preferred because of their adaptability and compactness, but, as is known in the art, either analog or digital components can achieve the functions and results described in association with the invention.

It is understood that during operation of the invention of FIG. 1, master unit 58 will maintain ultimate control of the furance output. Increases in output caused by the invention will result in the fuel valve 20 closing proportionally to the gain in efficiency. The air control 56 will close damper 26 in proportion to the air-to-fuel ratio that resulted in the change in efficiency. Likewise, air control 56 opens in proportion to the air/fuel ratio set by the device when the loads increase.

Figure 2:
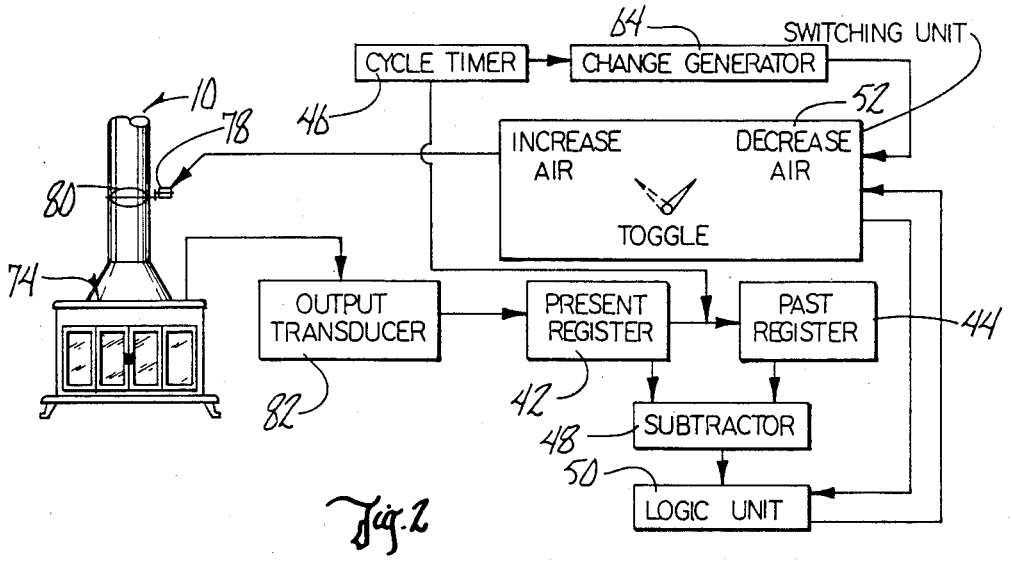
FIG. 2 is a schematic of the invention as applied to a fixed fuel input combustion device, namely, a wood burning stove.
Figure 3:
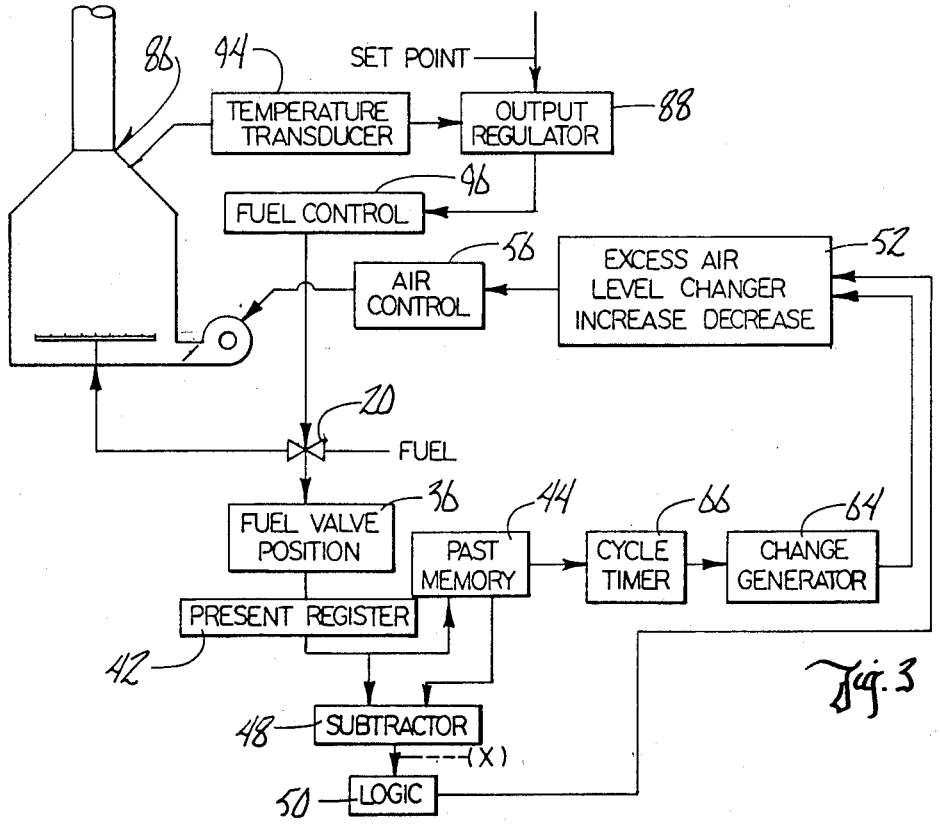
FIG. 3 is a schematic of the invention as applied to combustion devices having a fixed output level to maintain, namely, a furnace.

Having discussed the preferred embodiment of FIG. 1, the alternative preferred embodiments of FIGS. 2 and 3 correspond accordingly in the same general mode of operation, but have the following differences, as noted.

In the preferred embodiment of FIG. 2, the rate of input is ignored since the combustion device (in this case a woodburning stove 74) is batch fired (has a generally fixed fuel input). Cycle timer 46 resets the "sample and hold" past register 44. Cycle timer 46 also operates a damper control motor 78 for a short period (one to two seconds). Subtractor 48 then evaluates the change in output by subtracting the past output (stored in past register 44) from the present output (taken directly from output transducer 82). The logic unit 50 controls a reversing relay or switching unit 52 in accordance with the logic employed for FIG. 1. Output transducer 82 would simply take a reading from a temperature monitor placed within stove 74.

Basically, there is no practical way to control the heat output of the wood stove 74. Generally, the objective is to obtain maximum heat output. Therefore, the invention operates to find the optimum efficiency of wood stove 74 so that combustion is at an optimum efficiency which causes optimum output. The circuitry tests continuously to achieve the best position of damper 80 to again achieve minimum excess air for maximum efficiency, but never allows excess air to fall below the optimal minimum.

Thus, it can be seen that the invention can be successfully applied to small combustion devices 10 and achieve an advantageous result.

FIG. 3 depicts an embodiment of the invention as applied to a furnace 86 which is used to produce heat at a set temperature (fixed output), such as a furnace for a building or for industrial use requiring a certain uniform temperature. Such furnaces 86 are conventional within the art, and contain a temperature output regulator 88 having a manually or automatically inputtable set point which, in the simplest form, is a thermostat. An output transducer 94 is connected to temperature regulator 88. Therefore, temperature regulator 88 is constantly signalled as to the temperature output of furnace 86 and thus controls fuel control 96 which in turn controls fuel valve 98 which increases or decreases the amount of fuel entering furnace 86 to maintain the set temperature.

It can thus be seen that in this preferred embodiment of FIG. 3, the invention only looks at rate of fuel input and is not multiplied by rate of output. The other elements of the embodiment of FIG. 3 are similar to or the same as those in FIGS. 1 and 2, namely cycle timer 66, change generator 64, reversing relay or switching unit 52, logic unit 50, subtracter 48, past and present registers 44 and 42, and air control 56. A fuel valve position device or fuel rate indicator 36 sends the signal to be stored in present register 42.

The means of controlling the air control 56 depends on the furnace and its control system. It can be connected in cascade with the air control 56.

The invention of FIG. 3 thus, although it has a variable fuel supply, is designed to achieve a steady state output, and therefore the temperature regulator 88 constantly adjusts fuel input to maintain temperature. During this process, the control circuitry continuously tests and increases and decreases air input to find the minimum amount of fuel input for a given temperature. If efficiency is increased by a decreasing air input, and the requirement of fuel decreases, temperature regulator 88 will sense this change and decrease fuel input.

The above description sets forth the preferred embodiments of this invention, as to both apparatus and method. It will be appreciated that the present invention can take many forms and embodiments. The true essence and spirit of this invention are defined in the appended claims, and it is not intended that the embodiments of the invention presented herein should limit the scope thereof.

The elements of the invention shown in the drawings are all conventional and known within the art. The drawings show the invention as an analog device, but, for example, all the elements inside the dashed line in FIG. 1 could be replaced by digital components such as a digital microprocessor.

What is claimed is:

1. A method of optimizing efficiency of a combustion device such as a furnace, boiler, oven, stove or the like wherein required combustion device output is variable and fuel input is variable, comprising:

monitoring the rates of fuel input and combustion device output of said combustion device;

obtaining first readings of fuel input and combustion device output;

dividing said first combustion device output reading by said first fuel input reading to derive a first quotient of combustion device output to fuel input;

increasing the air input by a first amount to said combustion device;

obtaining second readings of combustion device output and fuel input;

dividing said second combustion device output reading by said second fuel input reading to derive a second quotient of combustion device output to fuel input;

recording said second quotient;

subtracting said first quotient from said second quotient to derive a remainder representing change in rate of combustion device output for said combustion device;

increasing input air again if said remainder is positive and the excess air level was previously increased;

decreasing input air if said remainder is negative and the excess air level was previously decreased;

if the remainder is negative and the excess air level was previously increased, the excess air level is then decreased; and if the remainder is negative and the excess air level was previously decreased, the excess air level is then increased.

2. The method of claim 1 wherein said air input is always reset to an initial air increase setting before the method is begun.

3. The method of claim 1 wherein when said remainder alternates between negative and positive, said first time period is incrementally reduced.

4. The method of claim 2 comprising the further step of resetting said incremental air changes to said increased setting if said remainder is equal to zero, and the excess air level previously was decreased.

5. The method of claim 1 wherein if excess air was increased or decreased and was trimmed and the remainder results in zero or close to zero, the increment changes are stopped and output and input are monitored for a negative value.

6. The method of claim 5 wherein the incremental changes in the excess air level are restarted after a negative remainder.

7. The method of claim 1 wherein said second quotient is derived only after waiting a sufficient time period for said output to stabilize to the change in input air.

8. The method of optimizing combustion efficiency in combustion devices such as furnaces, boilers, stoves, ovens, and the like, wherein said combustion device has a fixed fuel supply and produces an output having a temperature component, comprising the steps of:

initiating combustion in said combustion device by inputting said fixed supply of fuel, introducing an initial amount of input air, and instigating combustion;

monitoring said output of said combustion device;

recording for subsequent comparison a first output reading for said combustion device;

increasing the amount of combustion air from said initial setting entering said combustion device;

recording a second output reading;

subtracting said first output reading from said second output reading;

increasing the amount of combustion air again if the remainder between said second output reading and said first output reading is positive or zero;

decreasing the amount of combustion air if the remainder between said second output reading and said first output reading is negative;

thereby increasing or decreasing the combustion air to maximize output of said combustion device as the fixed fuel supply is used up.

9. The method of claim 8 wherein the time period between increasing the amount of excess air and recording a second output reading is adjustable.

10. A method of operating a combustion device such as a furnace, boiler, stove, oven or the like at a desired output by inputting variable amounts of fuel to maintain said desired output, comprising the steps of:

monitoring the rate of fuel input of said combustion device;

recording a first rate of fuel input reading;

increasing the air being input to said combustion device from the initial air input level;

recording a second rate of fuel input reading;

subtracting the second rate of fuel input reading from the first rate of fuel input reading to derive a remainder representing the change in fuel input;

increase air input into the combustion device if the remainder is positive and repeating increase in air input if the remainder is positive;

decreasing the air input into said combustion device if the remainder is negative;

repeating the decrease in air if said remainder is positive; and increasing the air input in the remainder is negative or zero after previously decreasing input air.

11. A means for optimizing efficiency of a combustion device such as a furnace, boiler, oven, stove and the like, wherein the input fuel supply and input air supply is variable, comprising:

an output monitoring means for continuously deriving output levels of said combustion device;

an input monitoring means for continually monitoring fuel input to said combustion device;

air control device means operatively connected to the means for controlling air input into said combustion device for controlling the exact amount of said input air into said combustion device;

means to convert the readings for fuel input and output into electrical signals representing fuel input and output;

divider math unit means in electrical communication with said output and input reading means for dividing said output reading by said fuel input reading to derive a ratio of combustion device output to fuel input;

a first signal storage means in electrical communication with said divider means for storing a present output ratio of said divider means, and being updatable upon each division of said divider means;

a second signal storage means in electrical communication with said divider means which stores a past output ratio of said divider means, and has a electronic means to hold said past output ratio until said second storage means is updated;

a math unit subtracter means for subtracting the contents of said second signal storage means from said first signal storage means to derive a remainder representing a change between said present output ratio and said past output ratio, said subtracter means being in electrical communication with said first and second storage means;

a math unit logic means in electrical communication with said subtracter means which produces a signal if the said remainder of said subtracter means is negative and does not produce a signal if said remainder is positive;

an electronic switching means in electrical communication with said logic means and said air control bias means for directing said air control bias means to either increase air input or decrease air input into said combustion device, said switching means having an increased air state which sends an increased air input signal to air control bias, and a decrease air state which sends a decrease air input signal to said air control bias, said switching means being initially in said increase air state and continuing in said increase air state until said signal is received from said logic means which would switch said switching means to said decrease air state, any said signal from said logic means switching the states of said switching means; and timing means to control sequencing of the elements of the means.

12. The means of claim 11 wherein said logic means further comprises means to send a signal to said switching means if said remainder of said subtracter means equals zero and said switching means is in said decrease air state.

13. The means of claim 11 further comprising manual adjustable means for determining the amount of change in said air control bias to either increase or decrease air input.

14. The means of claim 11 further comprising a trimmer means for automatically decreasing the amount of change signalled by said dwell means to constantly reduce the amount of air increase or air decrease signalled by said switching means.

15. A means for optimizing efficiency of a combustion device such as a furnace, boiler, oven, stove, and the like wherein the amount of fuel input is fixed, comprising:

a motor means operatively connected to the air damper of said combustion device for moving said air damper between a minimum and maximum air input position;

an output reading means operatively connected to said combustion device to derive a representation of output of said combustion device;

a transducer means to convert the output readings of said output reading means into an electrical signal;

a first electronic signal storage means in electrical communication with said output transducer means for storing a present output reading signal;

a second electronic signal storage means in electronic communicaton with said first storage means for storing a past output reading;

a clock means in electronic communication with said second electronic signal storage means which causes said second storage means to hold an output reading until a subsequent signal is entered into said first electronic signal storage means, so that said second storage means always contains the immediately prior output reading to that of the first storage means;

a math unit subtracter means in electrical communication with said first and second storage means for subtracting the past reading of said second storage means from the present reading of said first storage means to derive a remainder representing the change in output of said combustion device;

a logic means in electrical communication with said subtracter means which generates an electronic signal if the said remainder of said subtracter means is zero or negative;

a switching toggle means in electronic communication with said logic means and with said air control means, said switching means having an air increase state and an air decrease state, said switching means always beginning in said increase state which causes said air control to increase the amount of air input into said combustion device, said switching means being responsive to said logic means so that the state of said switching means is continued until a signal is received from said logic means which then switches the state of said switching means.

16. The device of claim 15 further comprising a dwell means which is adjustable to electronically set the amount of air increase or air decrease signal by said switching means.

17. A means for optimizing efficiency of a combustion device such as a furnace, boiler, oven, stove, and the like, wherein said fuel input and air input are variable to maintain a desired output level, comprising:

an output reading means operatively connected to said combustion device for monitoring the output of said combustion device;

an output reading transducer which converts the output reading of said output reading means into an electric signal;

a fuel control means in operative connection with a fuel input means which controls the amount of fuel input into said combustion device;

an output regulator means electronically connected to said output transducer means and said fuel control means, having an adjustable means for setting the desired output level and signalling said fuel control means to input sufficient fuel to maintain the set output level according to the readings of said output transducer;

a first electronic signal storage means in electronic communication with said fuel control means to store the present value of said fuel control means;

a second electronic signal storage means connected to said present electronic signal register means which stores the present fuel control reading and has a clock means attached thereto so that said second storage means stores the immediately preceding fuel control level to that of said first storage means to represent a change in fuel input to said combustion device;

a math unit subtracter means which subtracts said past reading from said present reading to represent a change in fuel input;

a logic means which is electronically connected to said subtracter means and which issues a signal if the fuel is raised or lowered;

a toggle switching means connected to said logic means and to an air control means, said switching means having an air lower state and an air higher state so that upon signalling from said logic unit, said toggle switches between the two states to raise or lower air input according to fuel input to maintain the optimum excess air level.

* * * * *